US006645403B1

(12) United States Patent
Park et al.

(10) Patent No.: US 6,645,403 B1
(45) Date of Patent: Nov. 11, 2003

(54) MULTIPHASE ELECTRORHEOLOGICAL FLUID

(75) Inventors: O Ok Park, Taejeon (KR); Byung Doo Chin, Taejeon (KR)

(73) Assignee: Korea Advanced Institute of Science and Technology (KR)

( * ) Notice: Subject to any disclaimer, the term of this patent is extended or adjusted under 35 U.S.C. 154(b) by 107 days.

(21) Appl. No.: 09/644,142

(22) Filed: Aug. 22, 2000

(30) Foreign Application Priority Data

Aug. 28, 1999 (KR) ..... 1999-36128

(51) Int. Cl.[7] ..... H01B 3/24

(52) U.S. Cl. ..... 252/570; 252/73; 252/74; 252/75; 252/77; 252/500; 252/560; 252/572; 252/573

(58) Field of Search ..... 252/77, 74, 75, 252/73, 572, 500, 573, 570

(56) References Cited

U.S. PATENT DOCUMENTS

| | | | | |
|---|---|---|---|---|
| 3,397,147 A | | 8/1968 | Martinek | |
| 4,502,973 A | | 2/1983 | Stangroom | |
| 4,483,788 A | | 11/1984 | Stangroom et al. | |
| 4,668,417 A | | 4/1986 | Goossens et al. | |
| 5,417,847 A | | 12/1991 | Wijmans et al. | |
| 5,189,012 A | * | 2/1993 | Patel et al. | 507/103 |
| 5,437,806 A | | 8/1995 | Bryant et al. | |
| 5,569,642 A | * | 10/1996 | Lin | 507/103 |
| 5,595,680 A | * | 1/1997 | Bryant et al. | 252/77 |

FOREIGN PATENT DOCUMENTS

EP 0 394 005 A1 4/1990

OTHER PUBLICATIONS

Gow, et al., "Electrorheological Properties of Polyaniline Suspensions," *J. Colloidal and Interface Science*, vol. 126, No. 1, Apr. 1990, pp. 175–188.

Pan, et al., "Characteristics of Electrorheological Responses in an Emulsion System," *J. Colloida and Interface Science*, vol. 195, No. 1, 1997, pp. 101–113.

* cited by examiner

*Primary Examiner*—Yogendra N. Gupta
*Assistant Examiner*—Derrick G. Hamlin
(74) *Attorney, Agent, or Firm*—Perkins Coie LLP

(57) ABSTRACT

Disclosed herein is a multiphase electrorheological fluid having an improved yield stress and stability. The multiphase electrorheological fluid comprises a first liquid phase component as a continuous oil phase; particles dispersed in the continuous oil phase; and a second liquid phase component which consists of emulsion liquid droplets and is dispersed in the continuous oil phase while being immiscible with the continuous oil phase. The dispersed liquid droplets have higher electrical conductivity and dielectric constant than those of the continuous oil phase.

17 Claims, 4 Drawing Sheets

MULTIPHASE ELECTRORHEOLOGICAL FLUID

BACKGROUND OF THE INVENTION

1. Field of the Invention

The present invention relates in general to a multiphase electrorheological fluid, and more particularly to an electrorheological fluid comprising a suspension of solid particles and emulsion liquid droplets dispersed in a continuous oil phase, in which the emulsion liquid droplets are immiscible with the continuous oil phase. Thus, this electrorheological fluid has enhanced properties as compared to the conventional electrorheological fluid composed of a solid particle suspension in oil.

2. Description of the Prior Art

An electrorheological fluid has a fast response time of a few milliseconds and can be adjusted in its viscosity in response to a variation in electric field. Thus, it can be applied in various fields, such as electrically working active suspension systems, valves, brakes, artificial joints and so on.

Electrorheological phenomenon is associated with a variation in Theological properties of a suspension which occur when an external electric field is applied. The electrorheological fluid shows the same behavior as the usual Newtonian fluid in the absence of the electric field, but it is solidified in the presence of the electrical field and shows a strong flow resistance. A great variation in viscosity occurring in the electrorheological fluid is due to a variation in microstructure of a suspension. The application of the electrical field to a static suspension results in rearrangement of particles in the suspension by the polarization phenomenon occurring within the particles or on their surface, and forms a fibril structure connecting electrodes to each other. Where a strain is applied to the fibril structure of the particles perpendicular to the direction of electric field, the fibril structure is distorted. Energy consumed by this strain causes an increase in viscosity of the suspension. In this case, yield stress of the suspension is increased as electric field strength is increased. Meanwhile, if the applied shear stress is higher than the yield stress of the fluid, the fluid has fluidity. The electrorheological fluid responds to the electric field in a highly fast time of about $10^{-3}$ seconds, and this response is reversible, so that the electrorheological fluid can be employed as an excellent medium to transfer electrical signals to mechanical devices. There has been proposed many mechanical devices using the electrorheological fluid, including the clutches, high speed valves, and vibration-controlling active suspension systems.

Many kinds of dispersion mediums and particles are disclosed as components of the electrorheological fluid (U.S. Pat. Nos. 3,397,147; 4,483,788; 4,502,973; and 4,668,417). It is generally known that the electrorheological fluid contains a small amount of water adsorbed on particles dispersed therein (less than 10% by weight relative to the particle weight). Thus, by virtue of the ion polarization phenomenon occurring upon the application of the electric field, the electrorheological fluid exhibits the electrorheological effect by the formation of a chain structure or by the formation of a water-crosslinked structure between the particles.

The electrorheological activity of this fluid significantly depends on a variation in water content of the fluid. If this fluid is free of water, it disadvantageously loses its electrorheological activity and can be not used at high temperature. The fluid free of water also has drawbacks in the engineering view in that it results in high abrasion of a machine and is limited in its working temperature. It was recently reported that suspensions having completely dried inorganic or polymeric particles dispersed therein also have occurred the electrorheological phenomenon. In these suspensions, the dispersed particles are a semiconductor in their electrical property, and also the polarization phenomenon on the application of the electric field occurs by the migration of charge carriers by virtue of inherent physical and chemical properties of the particles other than occurring by water. U.S. Pat. No. 5,417,874 to Carlson et al. discloses an electrorheological fluid using inorganic particles of a crystalline lattice structure, which fluid can be worked at a temperature range of 25 to 150° C. However, the disclosed electrorheological fluid has a drawback in that the dispersed particles are high in their density and thus are easily settled.

Representative polymeric particles dispersed in the non-aqueous electrorheological fluid include polyaniline particles (See, "The Electrorheological Properties of Polyaniline Suspensions", J. Colloidal and Interface Science, Vol. 126, No.1, April 1990, pp. 175–188). European Patent Publication A 394,005 discloses an electrorheological effect of a suspension of 30% by volume polyaniline dispersed in a silicone oil. U.S. Pat. Nos. 5,595,680 and 5,437,806 describe non-aqueous electrorheological fluids using polyanilines and derivatives thereof polymerized from aniline monomers and a mixture of aniline monomers and various monomers.

A dispersion medium of the electrorheological fluid must have an electrically insulating property and may contain a surfactant to improve its stability. An effective dispersion medium generally needs to have a good dispersibility, a low viscosity and electrical conductivity, a high boiling point, a low freezing point, a chemical stability, and a high dielectric strength. U.S. Pat. No. 4,687,589 discloses physical property values required in the dispersion medium.

Halogenated oil is great in its specific gravity and less in its particle-settling degree, as compared to the conventionally used silicone oil. Also, the halogenated oil may be increased in its electrorheological activity as compared to the silicone oil, but a precious mechanism for this increase is not known. In the case where additives such as surfactant are included in the halogenated oil, their concentration needs to be limited to such a low degree that it is present only on the particle surface. A chain structure formed by the electric field is necessarily accompanied with the exhibition of the electrorheological phenomenon, and the shape and thickness of the chain depend on the physical and chemical properties of the components of the fluid. The performance and stability of electrorheological fluids developed up to now are difficult to meet a stress transfer property required in practical devices, and these fluids thus need to be improved in their performance and stability. Yield stress, a representative property, depends on the applied electric field strength and the particle volume fraction. To achieve a greater yield stress at a realizable electric field strength, increasing the particle volume fraction is effective. However, this particle volume fraction cannot disadvantageously exceed any maximum value, which is varied depending on a viscosity of the dispersion medium, and a shape and surface property of the particles. Moreover, an excessively concentrated dispersion system is excessively high in its viscosity in the absence of the electric field, as well as in the electric current leakage that causes the dielectric breakdown on the application of large electric field. For this reason, this dispersion system is disadvantageous in that it has insufficient controllability and stability. Thus, a new electrorheological fluid is required that is not excessively high in its particle concentration while having a high yield stress and an excellent stability.

In addition to the particles suspended in the insulating dispersion medium, an emulsion liquid droplet also undergoes an electrostatic interaction in the presence of the electric field. An article by Pan et al. has reported electrorheological properties of an emulsion under the electric field (Pan et al., "Characteristics of Electrorheological Response in an Emulsion System", J. Colloidal and Interface Science, Vol. 195, No. 1, 1997, pp.101–113).

SUMMARY OF THE INVENTION

We have found that an electrorheological fluid comprising a suspension of particles and emulsion liquid droplets dispersed in a continuous oil phase particles exhibits a highly stable microstructure in the form of a chain structure which is compositely formed by the particles and the emulsion liquid droplets. Based on this discovery, we have perfected the present invention.

It is therefore an object of the present invention to provide a new multiphase electrorheological fluid, which contains a continuous liquid phase and a dispersed liquid phase at optimally established viscosity and electrical property conditions, and can be thus highly increased in its yield stress without excessively increasing a volume fraction of particles dispersed in the continuous oil phase.

According to the present invention, a multiphase electrorehological fluid is provided. First liquid phase component is used as a continuous oil phase. Particles as well as second liquid phase component are dispersed in the continuous oil phase simultaneously while this emulsion drops are immiscible with the continuous oil phase. The dispersed liquid droplets have higher electrical conductivity and dielectric constant than those of the continuous oil phase.

BRIEF DESCRIPTION OF THE DRAWING

The above and other objects and aspects of the invention will be apparent from the following description of embodiments with reference to the accompanying drawings, in which.

DETAILED DESCRIPTION OF THE INVENTION

The present invention is characterized in that one or more liquid droplets are dispersed in a continuous oil phase, thereby forming a second dispersed phase in addition to dispersed particles as a first dispersed phase.

Where an electrical conductivity or dielectric constant of the liquid droplets as the dispersed phase is higher than that of the continuous oil phase, the dispersed liquid droplets on the application of an electric field forms a fibril structure connecting electrodes to each other. This microstructure is very unstable and easily broken as compared to a stable and strong chain structure exhibited in the particle dispersed system.

Generally, an emulsion of a first oil and a second oil that is immiscible with the first oil, and an emulsion of a polymer solution exhibit an electrorheological activity due to the formation of the microstructure between the electrodes when the electrical conductivity or dielectric constant of the dispersed liquid droplets is higher than that of the continuous liquid phase. This phenomenon is resulted from an electrical conductivity difference between the phases in the case of the application of a direct current electric field, while it resulted from a dielectric constant difference in the case of the application of an alternating current electric field. It is understood that these emulsions exhibit a very small increase in viscosity in the presence of the electric field and thus show a higher apparent viscosity than the electric field-free case by a few times. Also, these emulsions have such a low yield stress that cannot be almost measured.

However, where the dispersed particles and the emulsion liquid droplets are co-suspended in the continuous oil phase, the resulting electrorheological fluid exhibits, on the application of the electric field, a change in its microstructure into a chain which is compositely formed by the particles and the liquid droplets. This fluid has a stable structure as compared to the conventional particle-suspended system, and therefore shows a highly larger yield stress value at the same particle volume fraction.

The electrorheological fluid according to the present invention may be used regardless of the kind of the particles as long as it comprises the particles dispersed in the liquid phase component, which consists of the basic continuous oil phase and the emulsion liquid droplets immiscible with the continuous oil phase. The dispersed particles are featured in that they are first dispersed in the emulsion liquid droplets, and the remaining particles are uniformly dispersed in the continuous oil phase.

Figure 1:
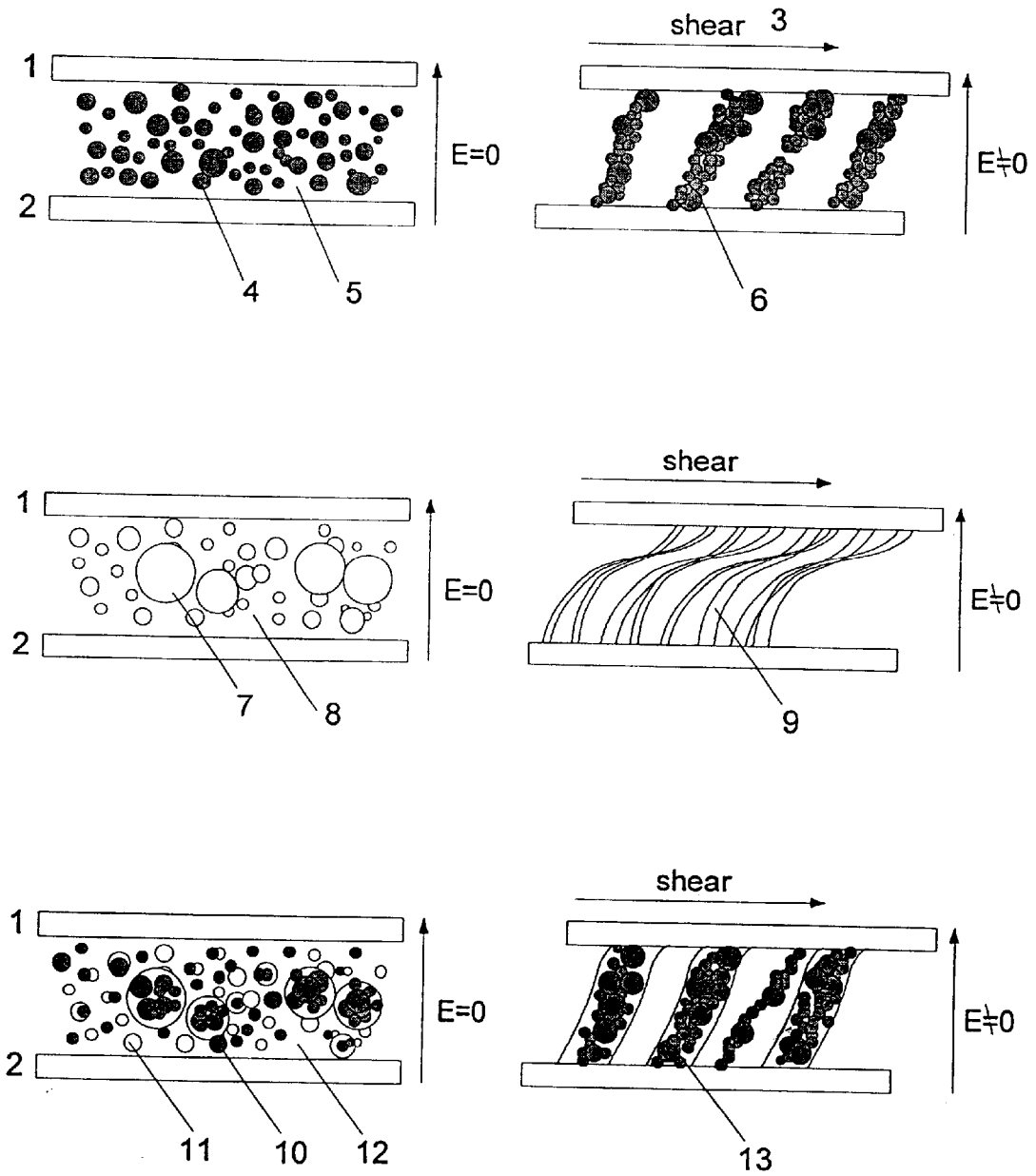
FIG. 1 shows microstructures of electrorheological fluids changed with the form of phases contained therein.

FIG. 1 schematically shows mechanisms for the microstructure formation by the electrorheological effect in a simple suspension system of particles in a continuous oil phase, an oil-oil emulsion system, and a system in which particles and emulsion liquid droplets are co-dispersed in a continuous oil phase.

Referring to FIG. 1, if an electric field is applied to a fluid between electrodes 1 and 2 in the perpendicular direction to the flowing direction of the fluid, electrorheological particles 4 dispersed in a continuous phase 5 are then formed into a chain shape structure 6. On the other hand, where the electric field is applied to the dispersed emulsion liquid droplets 7, these liquid droplets are then combined with each other and deformed, thereby forming an unstable microstructure 9. Where the electric field is applied to the system in which the particles 10 and the liquid droplets are co-dispersed in the continuous phase 12, a composite chain structure 13 is then formed.

The general behavior exhibited by the electrorheological fluid in the presence of the electric field can be described by a Bingham plastic model represented by the following formula $$\tau=\tau_y+\eta_p\gamma$$

where $\tau_y$ is a dynamic yield stress, $\eta_p$ is a plastic viscosity of a suspension, $\gamma$ is a shear rate, and $\tau$ is a shear stress. The electrorheological fluid exhibits a significant increase in yield stress $\tau_y$ in the presence of the electric field while showing little or no change in its plastic viscosity, as compared to the case where the fluid is free from the electric field. The dynamic yield stress corresponds to a shear stress at a point on a shear stress vs. shear rate curve at which the shear rate is zero.

Generally, the shear stress is used at a low shear rate value of about 0.1 $s^{-1}$. The yield stress $\tau_y$ is dependent on a volume fraction of the dispersed phase, material properties of the particles and dispersion medium, temperature, electric field strength, frequency and so on. Examples of the present invention is obtained from shear stress vs. shear rate data obtained on the application of a shear rate of 0.1 to 1000 $s^{-1}$ using PHYSICAL RHEOMETER (MC 120) with a measuring device equipped with Couette fixture. The measuring device has a gap of 0.59 mm between its electrodes. The electric is generated using a high voltage generator (Model EL5P8L, commercially available from GLASSMAN, Co.), and all experiments in Examples are carried out at room temperature (25° C.).

Any particles, such as non-aqueous polyaniline particles and water-containing silica particles, may be used as dispersed particles in the present invention, as long as they can exhibit an electrorheological activity when being suspended in an insulating liquid.

The following examples are for further illustration purposes only and in no way limit the scope of this invention.

EXAMPLE 1

This example illustrates the general preparation of multiphase electrorheological fluids used in the following Examples 2 to 5.

Oil-oil emulsions each having a volume of 50 $cm^3$ and a liquid droplet volume fraction of 0.1 to 0.3 were prepared using a silicone oil as a continuous oil phase, and a castor oil, Celeclor s45 and a chlorinated paraffin oil as liquid droplet, as shown in Table 1. All the liquid phase components used for the preparation of the emulsions were Newtonian oils and exhibited a constant Newtonian viscosity at a wide range of shear strain rate (0.05 to 1000 $s^{-1}$).

The emulsions were prepared by a simple mechanical stirring for 10 to 60 minutes of two liquids that are immiscible with each other. After preparing the emulsions, Particles of polyaniline or silica gel were dispersed in the respective emulsions to form the respective multiphase electrorheological fluid containing the particles and the liquid droplets. Table 1 shows physical properties of the components used for the preparation of the electrorheological fluid.

EXAMPLE 2

51.2 g of aniline and 500 ml of hydrochloric acid were mixed, and the solution was slowly stirred while maintaining a temperature at 0° C. After the aniline solution reached a thermal equilibrium, 100 ml of $(NH_4)_2S_2O_8$ aqueous solution was added to the aniline solution dropwisely. It could be confirmed that a reaction was initiated in 30 seconds and the solution was changed into dark green color. The reaction was continued for 24 hours. At the end of the reaction, the resulting solution was filtered, and the filtrate was repeatedly dispersed in distilled water and ethanol to purify the particles. The synthesized polyaniline particles were immersed in a 3% $NH_4OH$ aqueous solution for 24 hours to lower their electrical conductivity to a level of about $10^{-7}$ to $10^{-9}$ S/m. The resulting solution was filtrated, purified, dried at room temperature, and grounded with a mortar. The powder was further dried for 24 hours in a vacuum oven at about 90° C. The dried polyaniline particles had a number average particle diameter of about 32 $\mu$m and a density of 1.30 g/$cm^3$.

3.7 g of the polyaniline particles were dispersed in 17.1 g of a Celeclor s45/silicone oil emulsion (liquid droplet volume fraction $\Phi$=0.2) to produce a fluid. Also, 3.65 g and 3.6 g of the same polyaniline particles were dispersed in 17.2 g of a Celeclor s45/silicone oil emulsion (liquid droplet volume fraction $\Phi$=0.2) and 17.3 g of a Celeclor s45/silicone oil emulsion (liquid droplet volume fraction $\Phi$=0.3), respectively, to make fluids. For the comparison with a simple particles/oil dispersion system, 3.8 g of polyaniline particles were dispersed in 17.2 g of a pure silicone oil. In all the above cases, the polyaniline particles had a volume fraction ($\Phi_p$ of 0.130 (13.0% v/v) based on the total volume of the liquid phase component(s) (continuous oil phase and/or liquid droplets).

Figure 2:
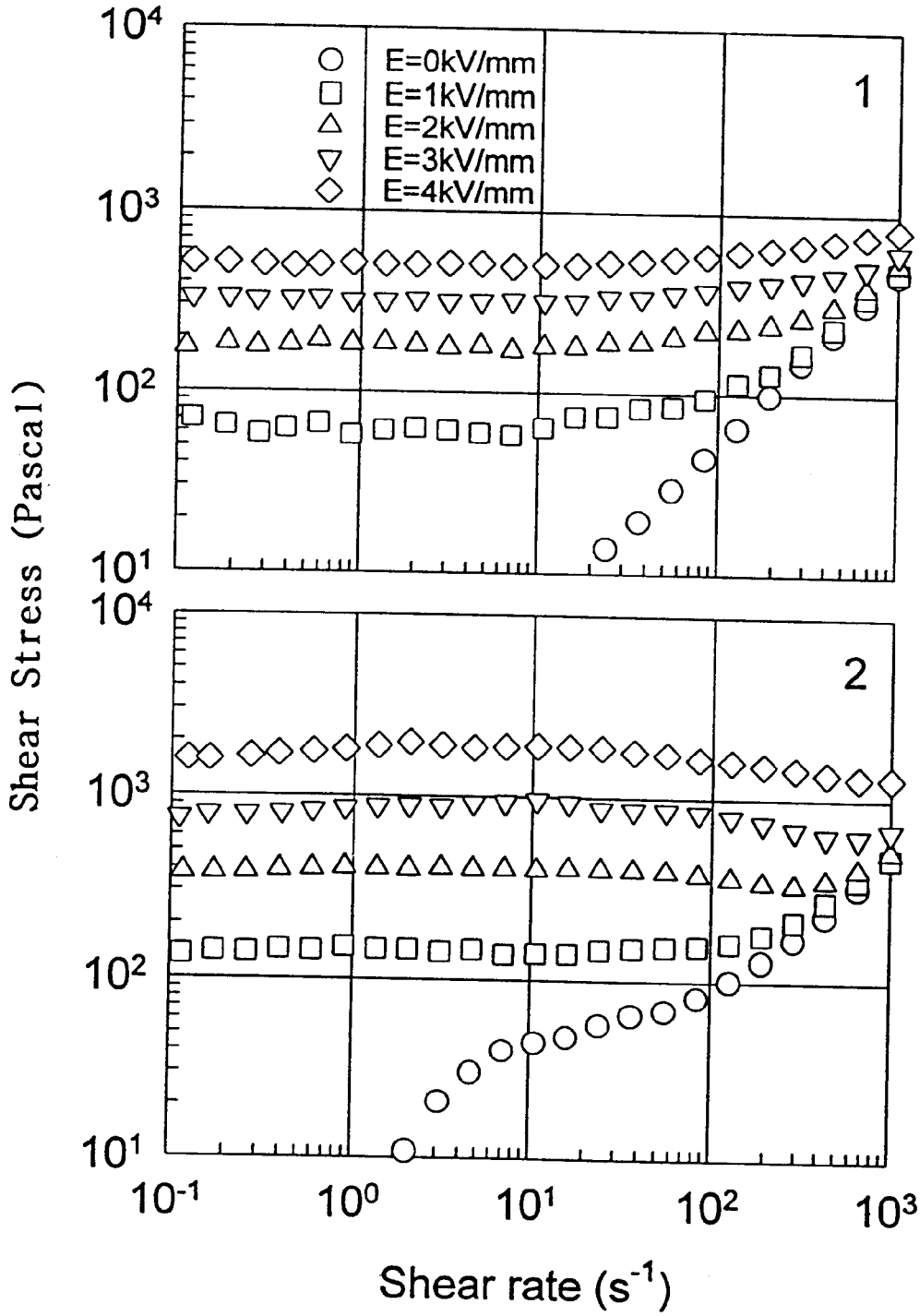
FIG. 2 shows shear stress of the electrorheological fluid changed with shear rate and electric field strength.

FIG. 2 shows a shear stress of electrorheological fluids according to electric field strength and shear rate. In FIG. 2, the reference numeral 1 shows data for the polyaniline/silicone oil suspension having a polyaniline volume fraction $\Phi_p$ of 0.130, and the reference numeral 2 shows results for the fluid in which polyaniline is suspended at the same volume fraction $\Phi_p$ in the Celeclor s45/silicone oil emulsion having a liquid droplet volume fraction $\Phi$ of 0.3.

Figure 3:
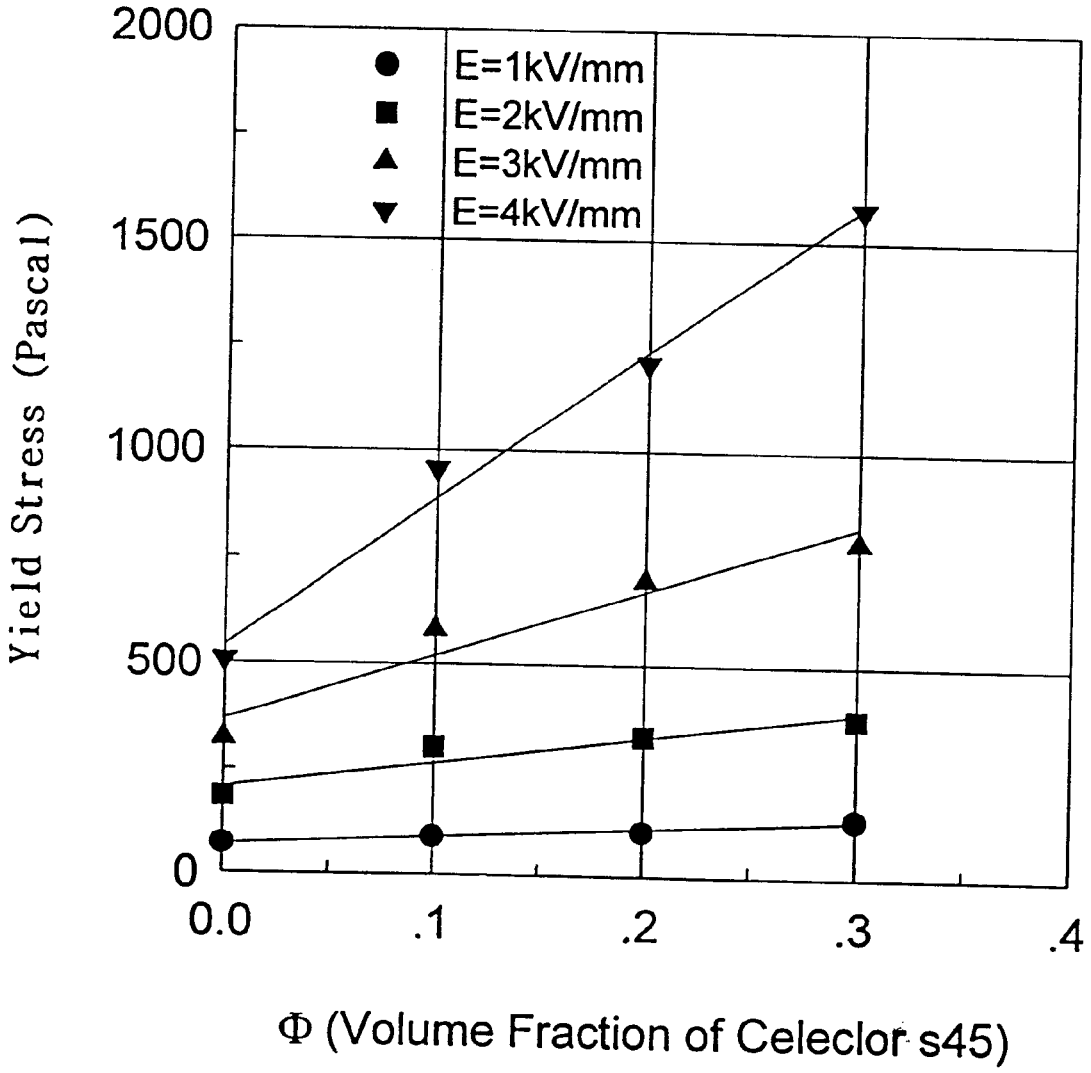
FIGS. 3 and 4 show yield stress of the electrorheological fluid changed with a volume fraction of liquid droplets in a continuous phase, and electric field strength.

FIG. 3 shows the correlation of a volume fraction ($\Phi$) of Celeclor s45 emulsion liquid droplets dispersed in a continuous oil phase with a yield stress in the case of a fluid containing the polyaniline particles at a volume fraction $\Phi_p$

TABLE 1

Physical Properties of Liquid Components and Dispersed Particles

| Physical | Liquid components | | | | Dispersed particles | |
|---|---|---|---|---|---|---|
| Properties | Silicone oil | Castor oil | Celeclors 45[a] | chlorinated paraffin oil | Poly-aniline[b] | Silica gel |
| Viscosity (25° C.) | 0.10 Pas | 0.75 Pas | 0.30 Pas | 4.50 Pas | | |
| Density (25° C.) | 0.96 g/$cm^3$ | 0.96 g/$cm^3$ | 1.16 g/$cm^3$ | 1.16 g/$cm^3$ | 1.30 g/$cm^3$ | 2.25 g/$cm^3$ |
| Dielectric constant (10 Hz) | 2.6 | 3.8 | 7.8 | 7.1 | | 4.0 |
| Electrical conductivity | $2.5 \times 10^{-12}$ S/m | $1.8 \times 10^{-11}$ S/m | $7.1 \times 10^{-10}$ S/m | $6.5 \times 10^{-10}$ S/m | $5.5 \times 10^{-9}$ S/m | |
| Volatility (25° C.) | 0.02 | | | | | |
| Particle diameter | | | | | 32 $\mu$m (average) | 40–63 $\mu$m (230–400 mesh) |

[a]chlorinated paraffin oil available from ICI Chemical.

[b]prepared by oxidation polymerization of aniline; treated in 3% $NH_4OH$ for 24 houres.

of 0.130 as the dispersed particle component, which correlation is indicated depending on an electric field varying in the range of 1.0 to 4.0 kV/mm. As can be seen from FIG. 3, an increase in volume fraction of the emulsion liquid droplets leads to a significant increase in yield stress of the electrorheological fluid. Also, in this case, not only a yield stress measured at a shear rate (dot γ) of 0.1 $s^{-1}$ but also a shear stress at a shear rate of $300^{-1}$ are significantly increased, and the current density of the electrorheological fluid is decreased. Results are indicated in Table 2 below.

TABLE 2

Properties of Polyaniline/Silicone Oil Electrorheological Fluid containing Celeclor s45 Liquid Droplets

| Volume fraction | Electric field strength | Yield stress (Pascal) | Shear stress (E ≠ 0)-Shear stress (E = 0) (Pascal), dot γ = 300 $s^{-1}$ | Current density ($\mu A/cm^2$), dot γ = 0 |
|---|---|---|---|---|
| Φ = 0 | E = 1 Kv/mm | 71 | 25 | 0.099 |
| (siliconee | E = 2 Kv/mm | 183 | 119 | 0.289 |
| oil | E = 3 Kv/mm | 320 | 291 | 0.559 |
| 100%) | E = 4 Kv/mm | 508 | 523 | 0.909 |
| Φ = 0.1 | E = 1 Kv/mm | 91 | 32 | 0.079 |
| (Celeclor | E = 2 Kv/mm | 303 | 124 | 0.269 |
| s45) | E = 3 Kv/mm | 581 | 338 | 0.549 |
| | E = 4 Kv/mm | 957 | 612 | 0.908 |
| Φ = 0.2 | E = 1 Kv/mm | 106 | 28 | 0.059 |
| (Celeclor | E = 2 Kv/mm | 331 | 156 | 0.247 |
| s45) | E = 3 Kv/mm | 700 | 406 | 0.546 |
| | E = 4 Kv/mm | 1210 | 683 | 0.889 |
| Φ = 0.3 | E = 1 Kv/mm | 139 | 29 | 0.039 |
| (Celeclor | E = 2 Kv/mm | 376 | 151 | 0.168 |
| s45) | E = 3 Kv/mm | 792 | 495 | 0.376 |
| | E = 4 Kv/mm | 1580 | 1286 | 0.762 |

EXAMPLE 3

2.25 g of the polyaniline particles prepared as described in Example 2 were dispersed in 17.0 g of a castor oil/silicone oil emulsion having a liquid droplet volume fraction Φ of 0.1. Also, 2.25 g of the same polyaniline particles were dispersed in a castor oil/silicone oil emulsion having a liquid droplet volume fraction Φ of 0.3.

For the comparison with a simple particle/oil dispersion system, 2.25 g of the polyaniline particles were dispersed in 17 g of a pure silicone oil. In all the cases of this example, the polyaniline were used at a particle volume fraction $\Phi_p$ of 0.100 (10.0% v/v) relative to the total volume of the liquid phase component(s).

Figure 4:
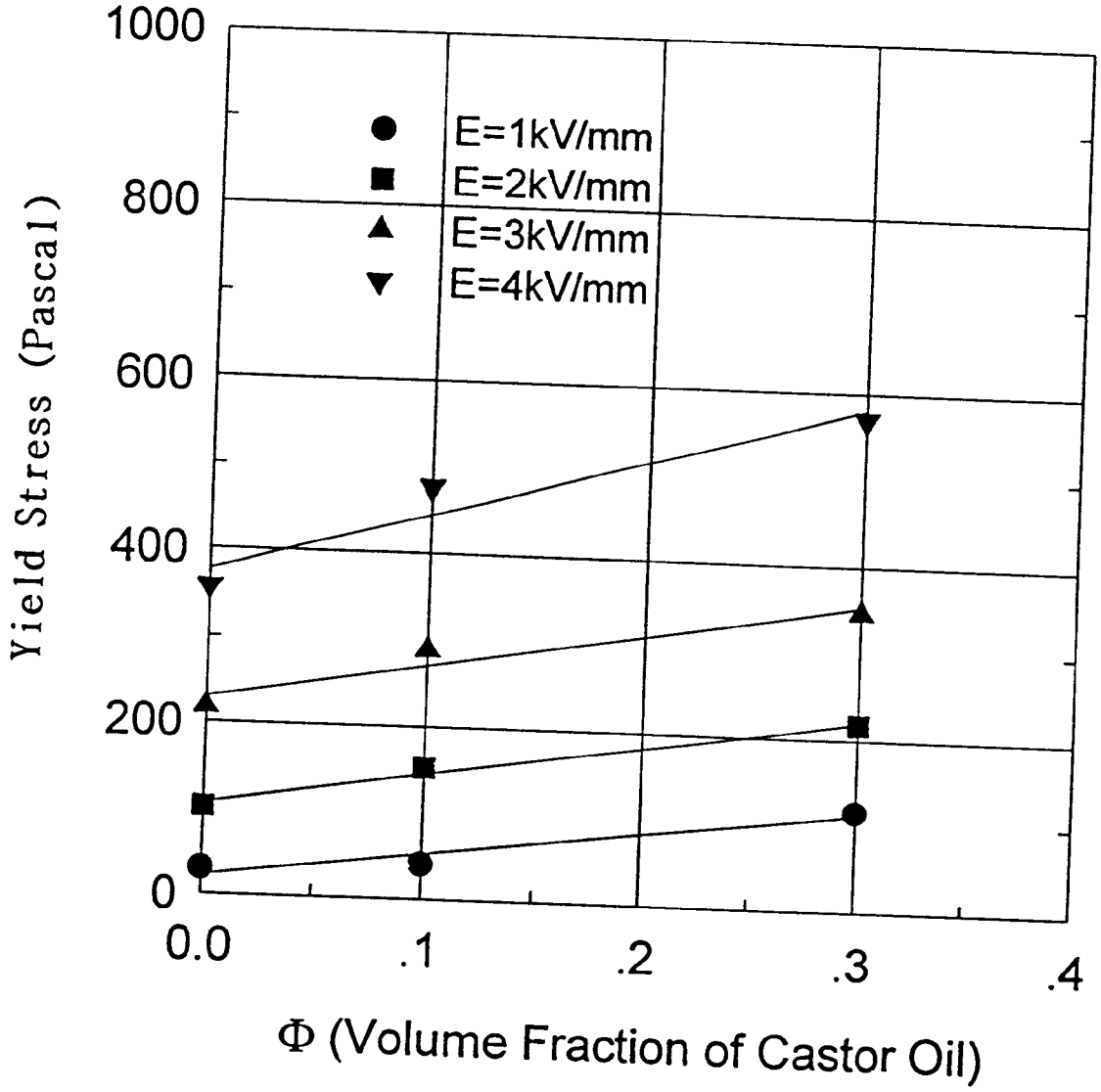

FIG. 4 shows the correlation of a volume fraction Φ of castor oil emulsion liquid droplets dispersed in a continuous oil phase with a yield stress in the case of a fluid containing the polyaniline particles at a volume fraction $\Phi_p$ of 0.100 as the dispersed particle component. The correlation is indicated depending on an electric field varying in the range of 1.0 to 4.0 kV/mm. As can be seen from FIG. 4, an increase in volume fraction of the emulsion liquid droplets leads to a significant increase in yield stress of the electrorheological fluid.

EXAMPLE 4

2.25 g of the polyaniline particles prepared as described in Example 2 were dispersed in 13.0 g of a chlorinated paraffin oil/silicone oil emulsion having a liquid droplet volume fraction Φ of 0.1. Also, 2.25 g of the same polyaniline particles were dispersed in 13.5 g of a chlorinated paraffin oil/silicone oil emulsion having a liquid droplet volume fraction Φ of 0.3.

For the comparison with a simple particle/oil dispersion system, 2.25 g of the polyaniline particles were dispersed in 12.75 g of a pure silicone oil. In all the cases of this example, the polyaniline particles were used at a volume fraction $\Phi_p$ of 0.115 (11.5% v/v) relative to the total volume of the liquid phase component(s). Results are shown in Table 3 below.

TABLE 3

Properties of Polyaniline/Silicon Oil Electrorheological Fluid containing Chlorinated Paraffin Oil Liquid Droplets

| Volume fraction | Electric field strength | Yield stress (Pascal) | Current density ($\mu A/cm^2$), γ = 0 |
|---|---|---|---|
| Φ = 0 | E = 1 kV/mm | 41 | 0.079 |
| (silicone oil | E = 2 kV/mm | 100 | 0.173 |
| 100%) | E = 3 kV/mm | 173 | 0.356 |
| | E = 4 kV/mm | 249 | 0.709 |
| Φ = 0.1 | E = 1 kV/mm | 56 | 0.179 |
| (chlorinated | E = 2 kV/mm | 156 | 0.539 |
| paraffin oil) | E = 3 kV/mm | 283 | 1.048 |
| | E = 4 kV/mm | 419 | 2.096 |
| Φ = 0.3 | E = 1 kV/mm | 196 | 0.230 |
| (chlorinated | E = 2 kV/mm | 345 | 0.768 |
| paraffin oil) | E = 3 kV/mm | 522 | 1.578 |
| | E = 4 kV/mm | 788 | 3.120 |

EXAMPLE 5

Silica gel 60 available from Merck was used as particles for the dispersion in the oil. This silica gel has the water content of 4 wt % as measured by a Karl-Fisher method, and a particle diameter of 40 to 63 μm (230–400 mesh).

2.25 g of the silica gel particles were dispersed in 8.8 g of a chlorinated paraffin oil/silicone oil emulsion having a liquid droplet volume fraction $\Phi_p$ of 0.1. For the comparison with a simple particle/oil dispersion system, 2.25 g of the silica gel particles were dispersed in 9.0 g of the silicone oil. In all the above cases, a volume fraction $\Phi_p$ of the silica particles relative to the total volume of the oil was 0.100 (10.0% v/v). Results are shown in Table 4 below.

TABLE 4

Properties of Silica/Silicone Oil Electrorheological Fluid containing Chlorinated Paraffin Oil Liquid Droplets

| Volume fraction Φ | Electric field strength | Yield stress (Pascal) | Current density ($\mu A/cm^2$), γ = 0 |
|---|---|---|---|
| Φ = 0 | E = 1 Kv/mm | 45 | 0.047 |
| (silicone oil | E = 2 Kv/mm | 133 | 0.138 |
| 100%) | E = 3 Kv/mm | 235 | 0.335 |
| | E = 4 Kv/mm | 330 | 0.595 |
| Φ = 0.1 | E = 1 Kv/mm | 53 | 0.072 |
| (chlorinated | E = 2 Kv/mm | 162 | 0.282 |
| paraffin oil) | E = 3 Kv/mm | 324 | 0.569 |
| | E = 4 Kv/mm | 518 | 0.861 |

As apparent from the above description, the multiphase electrorehological fluid according to the present invention further contains the dispersed emulsion liquid droplets that are immiscible with the continuous oil phase, additionally to the suspension of the particles (dispersed phase) in the dispersion medium (continuous oil phase) constituting the general electrorehological fluid. Thus, this electrorehological fluid has a further improved electrorehological activity resulted from a change in its microstructure by interactions between the liquid droplets and the dispersed particles and between the dispersed particles in the presence of the electric field. As a result, the electrorehological fluid according to the present invention has a high performance, and eliminates unstability occurring when the dispersed particles are present at an excessively high volume fraction.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A multiphase electrorehological fluid comprising:

a first liquid phase component as a continuous oil phase;

particles dispersed in the continuous oil phase; and a second liquid phase component which consists of emulsion liquid droplets and is dispersed in the continuous oil phase while being immiscible with the continuous oil phase, with the dispersed liquid droplets having higher electrical conductivity and dielectric constant than those of the continuous oil phase.

2. The multiphase electrorehological fluid of claim 1, in which a dielectric constant ratio of the second liquid phase component to the continuous oil phase is in the range of 2 to 100, and an electrical conductivity ratio of the second liquid phase component to the continuous oil phase is 5 to $10^6$.

3. The multiphase electrorehological fluid of claim 1, in which the dispersed emulsion liquid droplets are present at a volume fraction of 1 to 49% by volume based on the total volume of the first and second liquid phase components.

4. The multiphase electrorehological fluid of claim 1, in which the dispersed emulsion liquid droplets has a viscosity of 0.01 to 10 Pa·s, and are present at a viscosity ratio range of 0.01 to 100 relative to the continuous oil phase.

5. The multiphase electrorehological fluid of claim 1, in which the continuous oil phase is silicone oil, and the dispersed liquid droplets are selected from the group consisting of castor oil and chlorinated paraffin oil.

6. The multiphase electrorehological fluid of claim 5, in which the chlorinated paraffin oil has a chlorination degree of 1 to 80%.

7. The multiphase electrorehological fluid of claim 1 or 3, in which the dispersed liquid droplets is a hydrophobic fluid immiscible with the silicone oil, and has an electrical conductivity of $5\times10^{-12}$ to $10^{-4}$ S/m at room temperature.

8. The multiphase electrorehological fluid of claim 1, in which the continuous oil phase is a castor oil, and the dispersed liquid droplets consist of a chlorinated paraffin oil.

9. The multiphase electrorehological fluid of claim 8, in which the chlorinated paraffin oil has a chlorination degree of 1 to 80%.

10. The multiphase electrorehological fluid of claim 1 or 3, in which the dispersed liquid droplets is a hydrophobic fluid immiscible with the castor oil, and has an electrical conductivity of $5\times10^{-12}$ to $10^{-4}$ S/m at room temperature.

11. The multiphase electrorehological fluid of claim 1, in which the continuous oil phase is a hydrophobic liquid, the dispersed liquid droplets consist of a hydrophobic liquid immiscible with the continuous oil phase, and an electrical conductivity ratio of the dispersed phase to the continuous phase is in the range of 5 to $10^{-6}$.

12. The multiphase electrorehological fluid of claim 1, in which the dispersed particles consist of polyaniline or derivatives thereof, and have an electrical conductivity of $10^{-10}$ to $10^{-3}$ S/m at room temperature.

13. The multiphase electrorehological fluid of claim 1, in which the dispersed particles consist of one selected from the group consisting of polyphenylene, polyvinyl pyrrolidone, polyvinyl pyridine and derivatives thereof, and have an electrical conductivity of $10^{-10}$ to $10^{-3}$ S/m at room temperature.

14. The multiphase electrorehological fluid of claim 1, in which the dispersed particles are composites consisting of an electrically conductive core and an insulating shell surrounding the core, and exhibit an electrorehological activity when being suspended in an insulating liquid.

15. The multiphase electrorehological fluid of claim 1, in which the dispersed particles is selected from the group consisting of a water-containing silica gel, starch, cellulose, zeolite, an ion exchange resin and water-containing particles, and have an electrical conductivity of $10^{-12}$ to $10^{-3}$ S/m at room temperature.

16. The multiphase electrorehological fluid of claim 1, in which the second liquid phase component further contains an emulsifying agent for its stabilization.

17. The multiphase electrorehological fluid of any of claims 12 to 15, in which the dispersed particles are present at a volume fraction of 3 to 50% based on the total volume of the first and second liquid phase components.

* * * * *